US010551092B2

(12) United States Patent
Jiang et al.

(10) Patent No.: US 10,551,092 B2
(45) Date of Patent: Feb. 4, 2020

(54) PULSE-TUBE REFRIGERATOR

(71) Applicants: ZHEJIANG UNIVERSITY, Hangzhou, Zhejiang (CN); SUMITOMO HEAVY INDUSTRIES, LTD., Tokyo (JP)

(72) Inventors: Xiao Jiang, Hangzhou (CN); Limin Qiu, Hangzhou (CN)

(73) Assignees: ZHEJIANG UNIVERSITY, Hangzhou (CN); SUMITOMO HEAVY INDUSTRIES, LTD., Tokyo (JP)

( * ) Notice: Subject to any disclaimer, the term of this patent is extended or adjusted under 35 U.S.C. 154(b) by 125 days.

(21) Appl. No.: 15/710,422

(22) Filed: Sep. 20, 2017

(65) Prior Publication Data

US 2018/0031283 A1 Feb. 1, 2018

Related U.S. Application Data

(63) Continuation of application No. PCT/CN2016/077610, filed on Mar. 29, 2016.

(30) Foreign Application Priority Data

Mar. 30, 2015 (CN) ..... 2015 1 0145151

(51) Int. Cl.

| | |
|---|---|
| ***F25B 9/00*** | (2006.01) |
| ***F25B 9/14*** | (2006.01) |
| *F25B 9/10* | (2006.01) |

(52) U.S. Cl.

CPC ..... *F25B 9/145* (2013.01); *F25B 9/10* (2013.01); *F25B 2309/1407* (2013.01); *F25B 2309/1413* (2013.01); *F25B 2309/1415* (2013.01); *F25B 2309/1418* (2013.01)

(58) Field of Classification Search

CPC ..... F25B 9/145; F25B 2309/1406; F25B 2309/1407; F25B 2309/1408; F25B 2309/1413; F25B 2309/1414; F25B 2309/1415; F25B 2309/1421; F25B 9/10

See application file for complete search history.

(56) References Cited

U.S. PATENT DOCUMENTS

| | | | | |
|---|---|---|---|---|
| 5,680,768 | A | 10/1997 | Rattray et al. | |
| 7,497,084 | B2 | 3/2009 | Xu et al. | |
| 8,418,479 | B2 | 4/2013 | Xu et al. | |
| 2006/0144054 | A1* | 7/2006 | Xu | F25B 9/10 62/6 |
| 2014/0338368 | A1 | 11/2014 | Nakano et al. | |
| 2016/0291104 | A1* | 10/2016 | Tsuda | H01F 6/04 |

FOREIGN PATENT DOCUMENTS

| | | | |
|---|---|---|---|
| CN | 1079044 | A | 12/1993 |
| CN | 101329114 | A | 12/2008 |
| CN | 102901263 | A | 1/2013 |

(Continued)

*Primary Examiner* — Keith M Raymond
(74) *Attorney, Agent, or Firm* — HEA Law PLLC

(57) ABSTRACT

A refrigerator includes a regenerator, a low-temperature end heat exchanger, a pulse tube, a high-temperature end heat exchanger, and a phase adjustment mechanism, connected in that order. A draft tube is provided inside the regenerator, paralleling the regenerator's axis, and the draft tube can extend into the low-temperature end heat exchanger.

11 Claims, 4 Drawing Sheets

(56) References Cited

FOREIGN PATENT DOCUMENTS

| | | | |
|---|---|---|---|
| CN | 204630136 | U | 9/2015 |
| GB | 2310486 | A | 8/1997 |
| JP | 2002-349981 | A | 12/2002 |
| JP | 2006-189245 | A | 7/2006 |
| JP | 2014-228171 | A | 12/2014 |
| KR | 2001-0083614 | A | 9/2001 |

* cited by examiner

PULSE-TUBE REFRIGERATOR

RELATED APPLICATIONS

Priority is claimed to Chinese Patent Application No. 201510145151.0, filed Mar. 30, 2015, and International Patent Application No. PCT/CN2016/077610, the entire content of each of which is incorporated herein by reference.

BACKGROUND

Technical Field

The present invention in certain embodiments relates to the refrigerator industry, and specifically relates to pulse-tube refrigerators.

Description of Related Art

Stirling-type pulse-tube refrigerators of advanced cooling capacity have invited research-and-development interest in recent years.

SUMMARY

The present invention in one embodiment affords a pulse-tube refrigerator comprising: an axially oriented regenerator, a low-temperature end heat exchanger, a pulse tube, a high-temperature end heat exchanger, and a phase adjustment mechanism, connected in that order; and a draft tube provided inside the regenerator, paralleling the regenerator's axial orientation.

DETAILED DESCRIPTION

Figure 1:
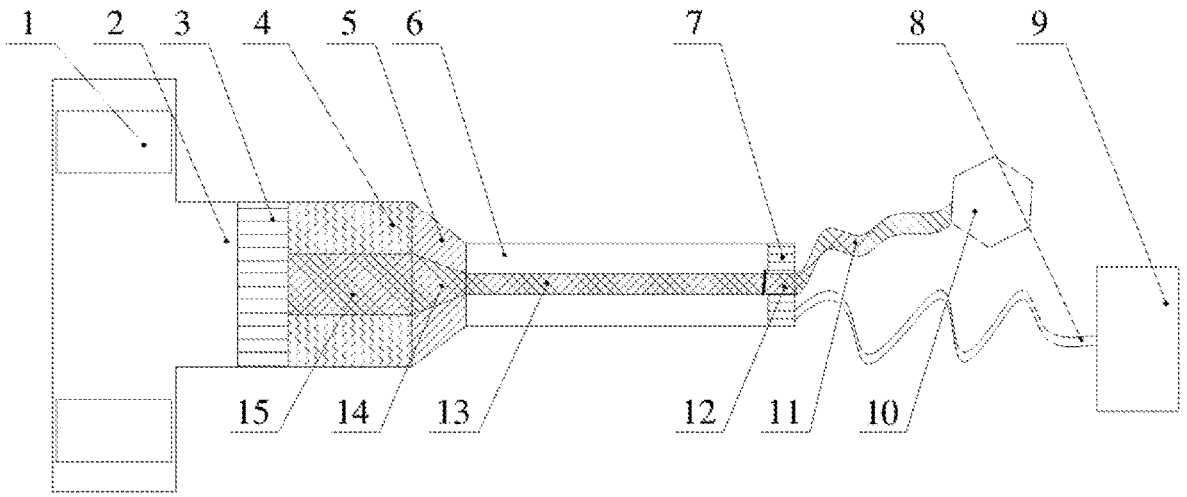
FIG. 1 is a structural schematic view of a pulse tube refrigerator according to an embodiment of the present invention.

The invention will now be described by reference to the preferred embodiments. This does not intend to limit the scope of the present invention, but to exemplify the invention. A detailed description will now be given of the embodiments of the present invention with reference to the attached drawings. Like numerals represent like elements so that the description will be omitted accordingly. The configurations described below are by way of examples only and are non-limiting.

In order to improve refrigeration capacity of a pulse tube refrigerator, it is necessary to use a regenerator and a pulse tube having a large diameter. However, according to increases of the diameters of the regenerator and the pulse tube, a bias-flow is likely to occur in a flow of a refrigerant inside the regenerator and the pulse tube. There is a concern that improvement of refrigeration performance is limited due to the bias-flow of the refrigerant.

It is desirable to provide a refrigerator which prevents a bias-flow from occurring in a refrigerant inside the refrigerator.

According to an embodiment of the present invention, there is provided the following technologies.

A draft tube is provided inside a regenerator, and thus, an air flow exchanging path in a lateral section (a cross section perpendicular to a circumferential direction) is blocked and decreased, a flow field becomes more uniform, a nonuniform phenomenon of a temperature inside the regenerator decreases, and it is possible to realize an effective operation of the refrigerator. Preferably, the draft tube may be provided coaxially with the regenerator.

As a preferred embodiment of the present invention, the draft tube may further extend into the low-temperature end heat exchanger. The draft tube extends into the low-temperature end heat exchanger, and thus, it is possible to decrease a degree of change in a diameter of a flow path in the low-temperature end heat exchanger. In addition, a gas flow distribution is optimized, a length of a fin of the low-temperature end heat exchanger is shortened, and thus, it is possible to increase a heat exchange capacity of the lower-temperature end heat exchanger.

Preferably, the draft tube may further extend into the pulse tube. The draft tube extends into the pulse tube, and thus, it is possible to change a circular pulse tube to an annular pulse tube, the change in the diameter between the regenerator and the pulse tube decreases, and it is possible to optimize the gas flow inside the pulse tube. More preferably, a draft tube segment positioned inside the pulse tube may be provided coaxially with the pulse tube.

Preferably, a flow-straightening mesh may be fixed to an outer wall of the draft tube segment positioned inside the pulse tube. In large mass flow situations, gas is restricted by the shapes of the low-temperature end heat exchanger and the high-temperature end heat exchanger, and thus, gas entering both ends of the pulse tube is not necessarily uniform. Accordingly, it is sufficiently necessary to use the flow-straightening mesh as a laminar flow part. However, it is difficult to fix the flow-straightening mesh, and particularly, it is very difficult to fix the flow-straightening mesh to the intermediate portion of the pulse tube. In the present invention, the draft tube extends into the pulse tube, and thus, a fixing position is provided to the flow-straightening mesh, and it is possible to easily dispose a flow-straightening layer inside the pulse tube.

Preferably, the draft tube may further extend into the high-temperature end heat exchanger.

At least one sensor may be disposed on an inner wall and/or an outer wall of the draft tube, the at least one sensor may communicate with an external measurement device by a lead wire, and the lead wire may penetrate the inside of the draft tube and extend to the external measurement device from a terminal of the draft tube positioned at the high-temperature end heat exchanger toward the outside.

The sensor is disposed in the draft tube, and thus, measurements on parameters such as a temperature and a pressure inside the refrigerator can be realized in situations where the flow field inside the refrigerator is not significantly influenced. By measuring a temperature and a pressure inside the refrigerator, it is possible to further promote a deeper understanding of the principle of the pulse tube refrigerator, and it is possible to advantageously obtain effective and practical loss control methods by analyzing a non-uniform phenomenon inside the regenerator with a small length/diameter ratio.

By combining the temperature measurement with respect to the inside of the regenerator and the temperature measurement with respect to the outer wall surface of the regenerator, it is possible to three-dimensionally obtain a temperature distribution at more positions of the regenerator, which gives important meaning in controls of studies with respect to non-uniformity inside the regenerator and optimization with respect to the refrigerator. By combining the temperature (no heat flow) measurement of the gas flow inside the low-temperature end heat exchanger and the temperature measurement with respect to the outer wall of the low-temperature end heat exchanger, it is possible to more realistically analyze the efficiency of the low-temperature end heat exchanger. By combining the temperature measurement with respect to the inside of the pulse tube and the temperature measurement with respect to the outer wall surface of the pulse tube, it is possible to a three-dimensional temperature distribution of the pulse tube, and thus, it is possible to obtain a guide action with respect to optimization of the pulse tube.

Preferably, the at least one temperature sensor is provided on the inner wall of the draft tube. Providing the temperature sensor on the inner wall of the draft tube does not affect the flow field inside the refrigerator.

A material of the draft tube is not particularly limited, and a material which reduces thermodynamic and fluid losses is mainly used. For example, the draft tube positioned inside the pulse tube may be formed of a material having low thermal conductivity. However, preferably, a portion of the draft tube in which the temperature sensor is provided may be formed of a thermally conductive material such that data measured by the temperature sensor has reliability and effectiveness.

Preferably, the sensor is a pressure sensor and may be fitted into the outer wall of the draft tube. According to this fitting type disposition, it is possible to maximize influences of the pressure sensor with respect to the flow field inside the refrigerator.

Cross sectional areas at locations of a draft tube segment positioned inside the regenerator may be the same as each other and a ratio between each of the cross sectional areas and a cross sectional area of the regenerator may be 1/20 to 1/2. In addition, cross sectional areas at locations of a draft tube segment positioned inside the pulse tube may be the same as each other and a ratio between each of the cross sectional areas and a cross sectional area of the pulse tube may be 1/20 to 1/2. The cross sectional area of the draft tube segment positioned inside the regenerator may be larger than the cross sectional area of the draft tube segment positioned inside the pulse tube. In order to smoothly transfer the draft tube from the regenerator to the pulse tube, preferably, cross sections on both ends of the draft tube segment positioned in the low-temperature end heat exchanger may be respectively matched to the cross sections of the draft tube segment positioned inside the regenerator and the draft tube segment positioned inside the pulse tube. According to this design, it is possible to reduce a degree of change in the cross section from the regenerator to the pulse tube, and it is possible to reduce a loss generated by the change of the cross section.

The shape and the size of the draft tube are not limited. However, in order to obtain preferable effects of the draft tube, preferably, an outer contour of the cross section of the draft tube may be circular or regular polygonal.

In order to obtain the best effects of the draft tube, preferably, the outer contour of the cross section of the draft tube is circular.

The draft tube of the present invention may be integrally molded, or a plurality of small parts may be assembled together based on actual situations. In a case where a plurality of small parts are assembled together, a method for connecting the parts to each other is not particularly limited, and various connection methods such as adherence, screw fitting, welding, or lock fitting may be used.

Preferably, the phase adjustment mechanism includes an inertance tube which communicates with one end separated from the regenerator in the high-temperature end heat exchanger and a gas tank which is connected to the inertance tube.

The refrigerator is a pulse tube refrigerator and the kind of the pulse tube refrigerator is not limited. That is, the pulse tube refrigerator may be an single-stage pulse tube refrigerator or a multi-stage pulse tube refrigerator, a thermo-coupled pulse tube refrigerator, a gas-coupled pulse tube refrigerator, a Stirling type pulse tube refrigerator, a GM type pulse tube refrigerator, an orifice type pulse tube refrigerator, a double inlet type pulse tube refrigerator, an inertance tube type pulse tube refrigerator, or a combined phase regulated pulse tube refrigerator with a double inlet and an inertance tube.

In a case where the refrigerator is a Stirling type pulse tube refrigerator, the refrigerator may further include a compressor, a transport tube, and an aftercooler which are connected to each other in order, and the aftercooler communicates with the regenerator.

Preferably, the draft tube extends and may penetrate the transport tube from the aftercooler. An extension segment of the draft tube can straighten gas compressed by the compressor.

In a case where the refrigerator is a GM type pulse tube refrigerator, the refrigerator further includes the aftercooler which communicates with the regenerator, the aftercooler includes a first gas pipe which is connected to a high-pressure gas source and a second gas pipe which is connected to a low-pressure gas source, and motor-operated valves are provided in both the first gas pipe and the second gas pipe.

According to the present invention, it is possible to prevent a bias-flow from occurring in the regenerator of the pulse tube refrigerator or a refrigerant inside the pulse tube.

A pulse tube refrigerator may mainly have the following technical problems. First, non-uniformity in a radial direction may be generated in a flow and a temperature inside a regenerator. Second, there may be an excessive heat exchange temperature difference in a low-temperature end heat exchanger under a large refrigerated amount. Third, it may be difficult to fix a flow-straightening mesh to the inside of a pulse tube. Fourth, it may not be possible to directly measure a temperature and a pressure inside the refrigerator. The problems may cause a non-negligible limitation on the performance improvement of a high cooling capacity Stirling type pulse tube refrigerator.

Regarding the first problem, the non-uniformity may be generated in the regenerator due to various causes. As a main cause, in a regenerator having a small length/diameter ratio in a high cooling capacity pulse tube refrigerator, if a relevance between heat power and hydraulic power in the radial direction is reduced and an increases of input power and/or a gradient of a temperature exceed a threshold value, a reflux is generated in the regenerator. And non-uniformity of the temperature caused by the reflux also further expands the reflux. With respect to a temperature non-uniformity phenomenon in the radial direction of the regenerator, in a main current method, a thermal conduction in the same cross section increases, a specific position of the regenerator is filled with fillers having high thermal conductivity or a different mesh number, an appropriate length/diameter ratio is adopted to decrease the input of acoustic power, or the like. However, all of which can only decrease the loss of the regenerator to a predetermined extent, and performance of the entire device is not remarkably improved. It is necessary to find out more effective methods.

Regarding the second problem, in a slit type low-temperature end heat exchanger which is commonly used, most of the research focuses on a heat exchange area inside to the heat exchanger and influences with respect to a flow field. As a result of the analysis, according to a rapid increase in the refrigerated amount, a heat flow rate per unit of the low-temperature end heat exchanger also increases drastically, and at the same time, a ratio of a performance loss of low-temperature end heat exchanger with respect to a performance loss of the entire device also increases gradually. Accordingly, optimization of the low-temperature end heat exchanger is a necessary condition for a refrigerator having high efficiency and a large refrigerated amount. In addition, according to the refrigeration capacity of the refrigerator, the diameter of the regenerator also increases correspondingly. Therefore, one portion in which the diameter is largely changed is present between the regenerator and the pulse tube, and it is necessary to transfer the inside of the low-temperature end heat exchanger which is relatively short. For example, if optimization of the flow path is not performed, a large eddy current loss is generated.

Regarding the third problem, the inside of the pulse tube is filled with the mesh s always to perform flow-straightening. However, since it is necessary to fix the mesh s, in the related art, in most cases, flow-straightening devices are disposed on both cold and heat ends of the pulse tube. According to an increase in mass flow and an increase in the diameter of the pulse tube, non-uniformity of the airflow is likely to occur in the intermediate portion of the pulse tube. Therefore, the mesh being installed in the intermediate portion of the pulse tube to perform flow-straightening has a practical meaning, and also in the related art, although it is experimented to dispose the mesh in the intermediate portion of the pulse tube, the disposition method is relatively complicated.

Regarding the fourth problem, parameters of the pulse tube refrigerator which is currently studied are mainly a temperature and a pressure. Here, in general, the temperature measurement is performed by disposing a thermometer on the wall surface of the regenerator and the wall surface of the pulse tube. However, it is impossible to obtain an actual temperature distribution of the inside by the temperature measurement. After that, an infrared imaging device is introduced to study a temperature field inside the pulse tube. However, a temperature measurement range is limited (the lowest temperature is 230K) and a problem occurs in a measurement principle (the filler of the regenerator is filled so as to be dense, which affects internal temperature imaging), and thus, neither of them can accurately and intuitively reflect the temperature and pressure inside the device. If it is possible to dispose a thermometer or a pressure gauge in the inside so as not to affect the device itself, it will have serious implications for research of the refrigerator.

If the above-described four problems are solved, the Stirling type pulse tube refrigerator can achieve dramatic development. In line with the evolution of the times, this can create large economic and social effects against large demands of an efficient and reliable low-temperature refrigerator.

The refrigerator of the present invention is a pulse tube refrigerator and the kind of the pulse tube refrigerator is not limited. That is, the pulse tube refrigerator may be an single-stage pulse tube refrigerator or a multi-stage pulse tube refrigerator, a thermo-coupled pulse tube refrigerator, a gas-coupled pulse tube refrigerator, a Stirling type pulse tube refrigerator, a GM type pulse tube refrigerator, an orifice type pulse tube refrigerator, a double inlet type pulse tube refrigerator, an inertance tube type pulse tube refrigerator, or a combined phase regulated pulse tube refrigerator with a double inlet and an inertance tube.

According to a pulse tube refrigerant according to the embodiment of the present invention, the following advantages can be obtained.

First, the draft tube is provided inside the regenerator, and thus, a gas flow exchanging path in a lateral section is blocked and decreased, a flow field becomes more uniform, a nonuniform phenomenon of a temperature inside the regenerator decreases, and it is possible to realize an effective operation of the refrigerator.

Second, the draft tube extends into the low-temperature end heat exchanger, and thus, it is possible to decrease a degree of change in a diameter of a flow path in the low-temperature end heat exchanger. In addition, a gas flow distribution is optimized, a length of a fin of the low-temperature end heat exchanger is shortened, and thus, it is possible to increase a heat exchange capacity of the lower-temperature end heat exchanger.

Third, the draft tube extends into the pulse tube, and thus, it is possible to form an annular pulse tube, the change in the diameter between the regenerator and the pulse tube decreases, and it is possible to optimize the gas flow inside the pulse tube. Moreover, a C portion provides a fixing portion in a flow-straightening mesh, and it is possible to easily dispose a flow-straightening layer inside the pulse tube.

Fourth, a sensor is disposed in the draft tube, and thus, measurements on parameters such as a temperature and a pressure inside the refrigerator can be realized in situations where the flow field inside the refrigerator is not significantly affected.

Hereinafter, embodiments of the present invention will be described in detail with reference to the drawings with a Stirling type pulse tube refrigerator as an example.

Figure 2:
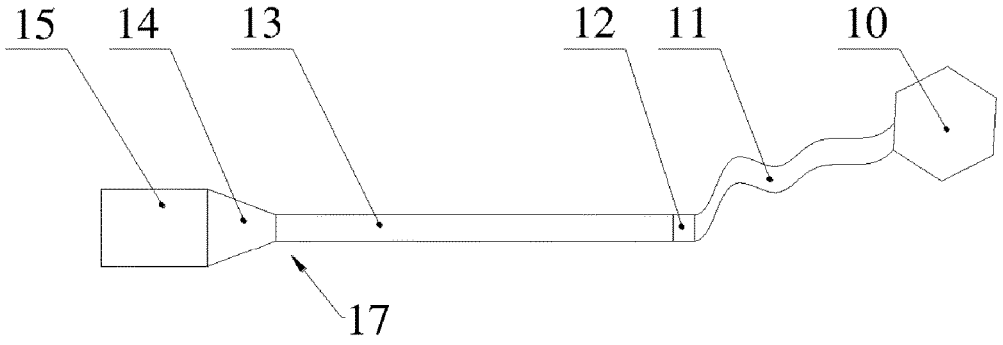
FIG. 2 is a structural schematic view of a draft tube in FIG. 1.

As shown in FIGS. 1 and 2, a pulse tube refrigerator according to an embodiment of the present invention includes a compressor 1, a transport tube 2, an aftercooler 3, a regenerator 4, a low-temperature end heat exchanger 5, a pulse tube 6, a high-temperature end heat exchanger 7, an inertance tube 8, and a gas tank 9 which are connected to each other in order. In a case where the refrigerator is operated, a temperature on one side of the regenerator 4 close to the pulse tube decreases, and a temperature gradient is generated from an end portion close to the compressor 1 to the one side close to the pulse tube. Accordingly, the end portion of the regenerator 4 close to the pulse tube side is referred to as a low-temperature end and the end portion thereof close to the compressor is referred to a high-temperature end. A draft tube is axially provided inside the regenerator 4. For example, the draft tube is a hollow cylindrical member. Since the draft tube is hollow, it is possible to decrease the amount of heat entering the low-temperature end from the high-temperature end of the regenerator. In addition, preferably, a plurality of openings are installed on a side wall of the draft tube such that an internal space of the regenerator communicates with an internal space of the draft tube. The plurality of openings are installed on the side wall of the draft tube, and thus, it is possible to maintain a filler at high purity. Moreover, the draft tube is not necessarily hollow, and a solid member formed of a material having a small thermal conduction coefficient may be used. Preferably, the internal space of the draft tube maintains an airtight state with respect to the atmosphere. Moreover, decompression may be performed on the internal space of the draft tube. The internal space of the draft tube and the internal space of the regenerator 4 may be separated from each other by the side wall of the draft tube so as not to communicate with each other. A draft tube segment positioned inside the regenerator, that is, a regenerator segment of the draft tube is referred to as an A portion 15. The A portion of the draft tube can be provided coaxially with the regenerator 4. The draft tube extends toward the low-temperature end heat exchanger 5 and can extend into the low-temperature end heat exchanger. A draft tube segment positioned inside the low-temperature end heat exchanger, that is, a low-temperature end heat exchanger segment of the draft tube is referred to as a B portion 14. The draft tube continuously extends and penetrates the low-temperature end heat exchanger 5 to extend into the pulse tube 6. A draft tube segment positioned inside the pulse tube, that is, a pulse tube segment of the draft tube is referred to as a C portion 13. The C portion of the draft tube can be provided coaxially with the pulse tube 6. The draft continuously extends and penetrates the pulse tube 6 to extend into the high-temperature end heat exchanger 7. A draft tube segment positioned inside the high-temperature end heat exchanger, that is, a high-temperature end heat exchanger segment of the draft tube is referred to as a D portion 12.

Figure 3:
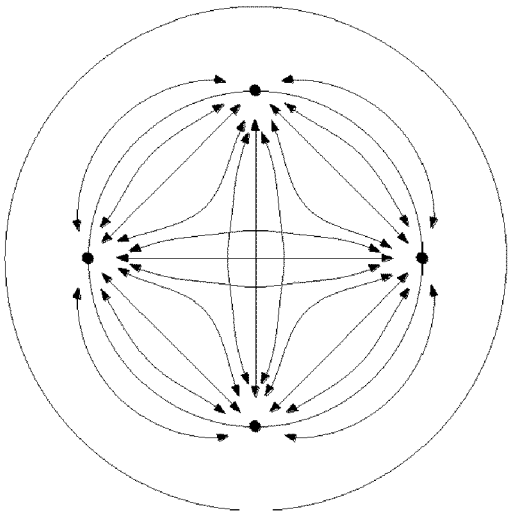
FIG. 3 is a cross sectional view of a regenerator of the pulse tube refrigerator in a case where the draft tube is not present.
Figure 4:
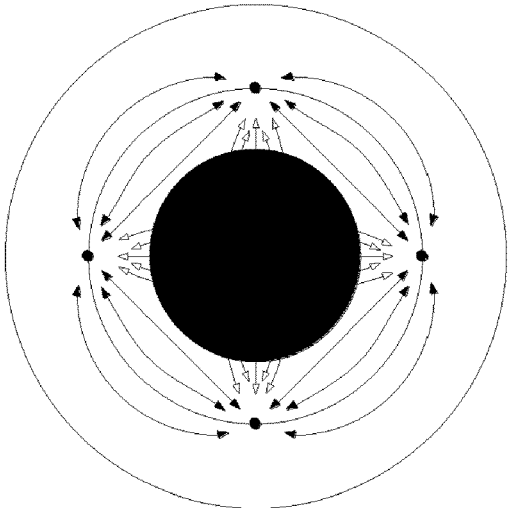
FIG. 4 is a cross sectional view of the regenerator of the pulse tube refrigerator in a case where the draft tube is present.

The inside of the regenerator 4 is filled with filler. For example, the filler may be a metal mesh formed of copper or the like. The A portion of the draft tube extends inside the regenerator 4 and the filler is an annular mesh corresponding to the shape of the draft tube. Since the filler fills the regenerator so as to protect the draft tube, a passage is reduced, through which refrigerant gas is exchanged between arbitrary two points (two points with no spatial difference) separated to be equidistance from a cross sectional center point in the same cross section of the regenerator. That is, since the refrigerant cannot flow straightly between two points, a flow resistance between the two points increases. FIG. 3 is a cross sectional view of the regenerator of the pulse tube refrigerator in a case where the draft tube is not present. FIG. 4 is a cross sectional view of the regenerator of the pulse tube refrigerator in a case where the draft tube is present. As shown in FIG. 4, compared to the situation of FIG. 3, since the A portion is provided, a gas exchange passage between two points with no spatial difference is reduced to a predetermined extent. When analyzed using a fluid network, the draft tube can increase the flow resistance between two points, and in a case where the same pressure difference is present in the draft tube, a gas exchange amount between two points with a large flow resistance is smaller. Accordingly, it is possible to decrease non-uniformity of the flow field.

Figure 5:
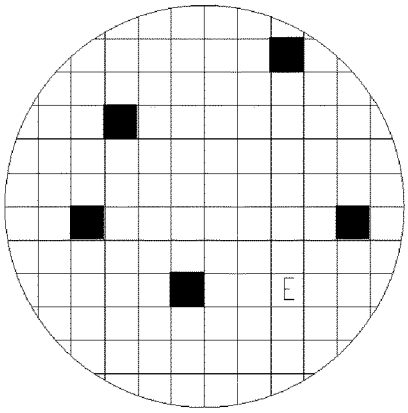
FIG. 5 is a miniaturized processing view of a cross section of the regenerator.
Figure 6:
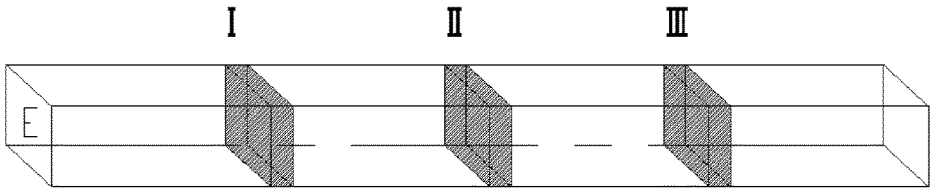
FIG. 6 is a schematic view showing an axial structure of a minute element E in FIG. 5.

FIG. 5 is a miniaturized processing view of a cross section of the regenerator. FIG. 6 is a schematic view showing an axial structure of a minute element E in FIG. 5. As shown in FIGS. 5 and 6, the regenerator is axially partitioned into innumerable small regenerators, that is, innumerable minute elements, and the regenerator is partitioned along the cross section of the regenerator into innumerable small regenerators, that is, innumerable minute elements. In an ideal situation (including a case where a radial nonuniform phenomenon is not present), all small regenerators in the same cross-section of the regenerator should not have a gas exchange to each other in any case. That is, there is no positional difference in any of black-filled regenerators. Therefore, the pressures are the same as each other in the same cross section. However, in an actual process, even when filling with the same uniform filler as uniform as possible, since there are various factors such as material discontinuity and filling process, even with one small regenerator, flow resistances with different unit distances in the axial direction randomly appear. Here, as an example of the minute element E, that is, I, II, and III portions are likely to have different gradients of pressure differences, and thus, it is not possible to guarantee a uniform flow resistance or it is not possible to distribute the flow as expected. In each of the small regenerators, the above-described situations are generated and the small regenerators are appeared to be randomly distributed to each other. However, since the same filling material and the same filling process are adopted, the randomly accumulated total flow resistance in the axial direction does not show significant differences between small regenerators. However, in the same cross section, due to the random flow resistance distribution in the axial direction, a pressure difference appears between two points with no originally spatial difference, and this pressure difference drives the mutual airflow exchange of small regenerator directly. Therefore, in general, radial non-uniformity appears, and the non-uniformity of the temperature in the radial direction to the outside is realized. As shown in the analysis of FIGS. 5 and 6, the addition of the draft tube reduces the airflow exchange between two points with no spatial difference. Accordingly, the non-uniformity phenomenon of temperature in the radial direction of the regenerator decreases, and the performance of the regenerator can be improved.

In addition, a flow-straightening mesh 20 may be also fixed to the outer wall of the C portion of the draft tube.

A plurality of temperature sensors (not shown) can be disposed on the inner wall of the draft tube and a plurality of pressure sensors (not shown) can be fitted to the outer wall of the draft tube. Each sensor can be connected to an external measurement device 10 via a lead wire 11. The lead wire 11 penetrates the inside of the draft tube and extends from a terminal of a portion positioned at the high-temperature end heat exchanger 7 in the draft tube to the external measurement device 10 toward the outside.

Figure 7:
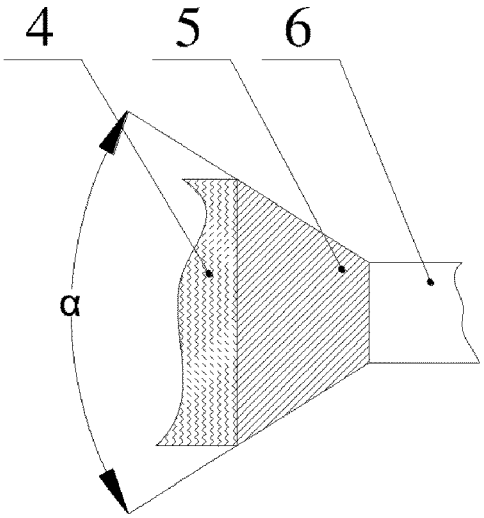
FIG. 7 is a structurally schematic enlarged view of a portion of the low-temperature end heat exchanger of the pulse tube refrigerator in a case where the draft tube is not present.
Figure 8:
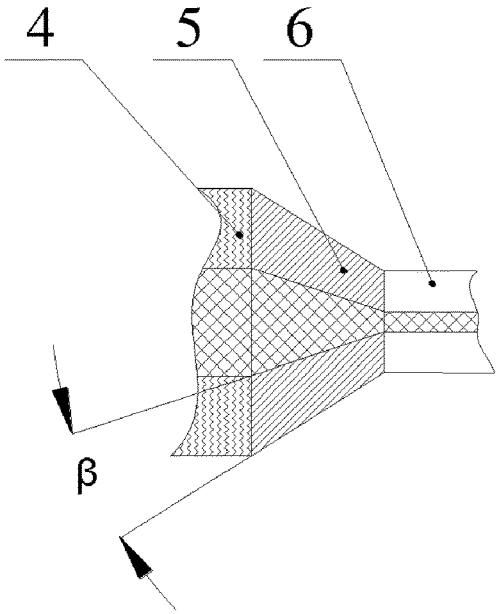
FIG. 8 is a partially enlarged view of the portion of the low-temperature end heat exchanger in FIG. 1.

According to a rapid increase in demand for refrigeration capacity, in the low-temperature end heat exchanger, a further increase in heat exchanger per unit volume is required. FIG. 7 is a structurally schematic enlarged view of a portion of the low-temperature end heat exchanger of the pulse tube refrigerator in a case where the draft tube is not present. FIG. 8 is a partially enlarged view of the portion of the low-temperature end heat exchanger in FIG. 1. As shown in FIGS. 7 and 8, the B portion of the draft tube is installed, and thus, the gas flow is concentrated on the outer end of the low-temperature end heat exchanger so as to reduce the heat resistance of heat exchange and to improve the efficiency of the heat exchanger. In addition, the B portion of the draft tube is installed, and thus, it is possible to directly decrease the degree of change in the diameter from the regenerator to the pulse tube. Moreover, when compared FIGS. 7 and 8, $\alpha>2\beta$ is satisfied, here, $\alpha$ is an angle of change in the diameter when the draft tube is not mounted, $2\beta$ is an angle of change in the diameter after the draft tube is mounted, and thus, the draft tube can effectively decrease an eddy current loss.

Figure 9:
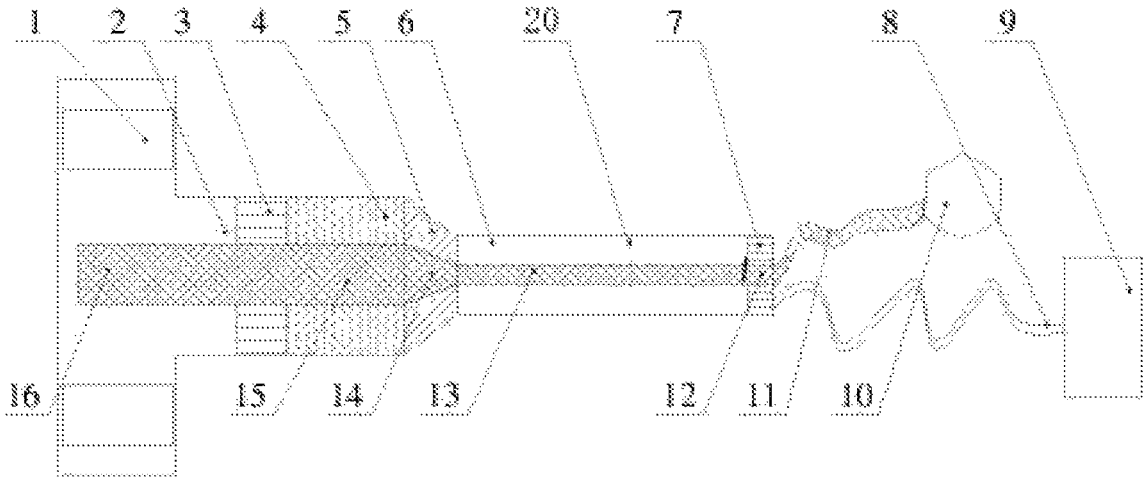
FIG. 9 is a structure schematic view of a pulse tube refrigerator according to another embodiment of the present invention.

FIG. 9 is a structure schematic view of a pulse tube refrigerator according to another embodiment of the present invention. The configurations of the present embodiment are the same as those of the embodiment described with reference to FIGS. 1 to 8 except that an extension portion 16 of the draft tube is added. In the following descriptions, the same reference numerals are assigned to the same configurations, and descriptions of the configurations and the effects are omitted.

As shown in FIG. 9, the draft tube extends to penetrate the aftercooler 3 and reaches the inside of the transport tube 2 such that the compressor compresses air to straighten the gas. That is, the draft tube may penetrate the aftercooler to form the draft tube extension portion 16 installed inside the transport tube or the extension portion may enter deep into the compressor.

Figure 10:
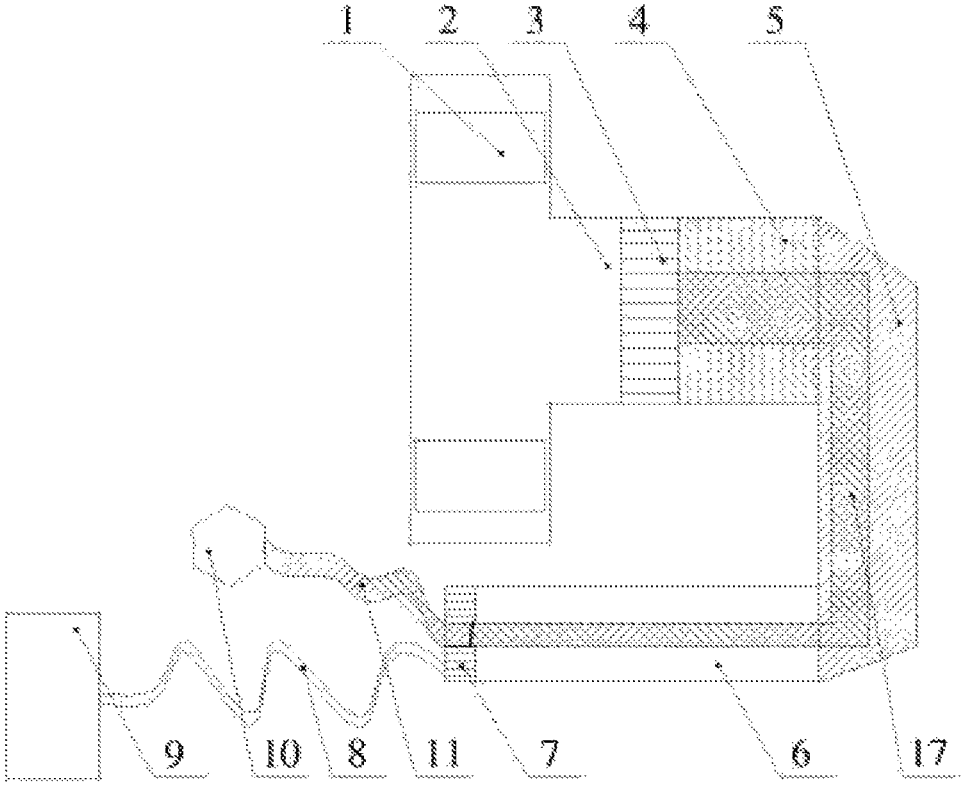
FIG. 10 is a structure schematic view of a refrigerator according to still another embodiment of the present invention.

FIG. 10 shows still another embodiment of the present invention. The configurations of the present embodiment are the same as those of the embodiment described with reference to FIGS. 1 to 8 except that the refrigerator is a U-shaped Stirling type pulse tube refrigerator. In the following descriptions, the same reference numerals are assigned to the same configurations, and descriptions of the configurations and the effects are omitted. As shown in FIG. 10, the A portion of the draft tube is provided inside the regenerator, and thus, an air flow exchanging path in a lateral section is blocked and decreased, a flow field becomes more uniform, a nonuniform phenomenon of a temperature inside the regenerator decreases, and it is possible to realize an effective operation of the refrigerator. The B portion of the draft tube is provided inside the low-temperature end heat exchanger, and thus, it is possible to decrease a degree of change in the diameter of the flow path in the low-temperature end heat exchanger, and an airflow distribution is optimized. Accordingly, the length of a fin of the low-temperature end heat exchanger is shortened, and thus, it is possible to increase a heat exchange capacity of the lower-temperature end heat exchanger. The C portion of the draft tube is provided inside the pulse tube, and thus, it is possible to form an annular pulse tube, the change in the diameter between the regenerator and the pulse tube decreases, and it is possible to optimize the gas flow inside the pulse tube. In addition, the C portion of the draft tube provides a fixing portion in the flow-straightening mesh, and it is possible to easily dispose the flow-straightening layer inside the pulse tube. The sensor is disposed in the draft tube, and thus, measurements on parameters such as a temperature and a pressure inside the refrigerator can be realized in situations where the flow field inside the refrigerator is not influenced.

In the present invention, the cross sectional areas at locations of the A portion are the same as each other and a ratio between each cross sectional area and the cross sectional area of the regenerator is 1/20 to 1/2. In addition, the cross sectional areas at locations of the C portion are the same as each other and a ratio between each cross sectional area and a cross sectional area of the pulse tube is 1/20 to 1/2. The cross sectional area of the A portion is larger than the cross sectional area of the C portion, and in order to smoothly transfer the A and C portions, the cross sections on both ends of the B portion are matched to the cross sections of the A portion and the C portion.

A material used to manufacture the draft tube is not particularly limited, and a material which reduces thermodynamic and fluid losses is mainly used. However, in the present invention, the portion of the draft tube in which the temperature sensor is provided may be formed of a thermally conductive material, for example, a material having favorable thermal conductivity such as copper, and other portions may be formed of a material having low thermal conductivity, for example, stainless steel such that data measured by the temperature sensor has reliability and effectiveness. The shape and the size of the draft tube are not limited. However, in order to obtain preferable effects of the draft tube, in the present embodiment, the outer contour of the cross section of the draft tube is circular.

In the present invention, the draft tube may be integrally molded, or a plurality of small parts may be assembled together based on actual situations. In a case where a plurality of small parts are assembled together, a method for connecting the parts to each other is not particularly limited, and various connection methods such as adherence, screw fitting, welding, or lock fitting may be used.

The entire draft tube is configured to be sealed to the atmosphere. However, the entire draft tube may be configured such that a working fluid inside the pulse tube is not sealed.

It should be understood that the invention is not limited to the above-described embodiment, but may be modified into various forms on the basis of the spirit of the invention. Additionally, the modifications are included in the scope of the invention.

What is claimed is:

1. A pulse-tube refrigerator, comprising:

an axially oriented regenerator, a low-temperature end heat exchanger, a pulse tube, a high-temperature end heat exchanger, and a phase adjustment mechanism, connected in that order; and a hollow draft tube comprising a regenerator draft-tube segment provided inside the regenerator, paralleling the regenerator's axial orientation, wherein right-angled cross-sections through any locus on the regenerator draft-tube segment are of identical planar area, and the planar area is 1/20 to 1/2 the regenerator's right-angled cross-sectional area, wherein:

the regenerator draft-tube segment extends into a pulse-tube draft-tube segment of the hollow draft tube located inside the pulse tube, and right-angled cross-sections through any locus on the pulse-tube draft-tube segment are of identical planar area, and the planar area is 1/20 to 1/2 the pulse-tube's right-angled cross-sectional area, wherein:

the right-angled cross-sectional area of the pulse-tube draft-tube segment is smaller than the right-angled cross-sectional area of the regenerator draft-tube segment; and a heat-exchanger low-temperature-end draft-tube segment of the hollow draft tube is provided in between the regenerator draft-tube segment and the pulse-tube draft-tube segment; and cross sections on either end of the heat-exchanger low-temperature-end draft-tube segment respectively match cross sections of the regenerator draft-tube segment and the pulse-tube draft-tube segment.

2. The pulse tube refrigerator according to claim 1, wherein the regenerator draft-tube segment is provided coaxially with the regenerator.

3. The pulse tube refrigerator according to claim 1, wherein the heat-exchanger low-temperature-end draft-tube segment extends from the regenerator draft-tube segment into the low-temperature end heat exchanger.

4. The pulse tube refrigerator according to claim 1, wherein the pulse-tube draft-tube segment extends from the regenerator draft-tube segment into the pulse tube.

5. The pulse tube refrigerator according to claim 4, wherein the pulse-tube draft-tube segment is provided coaxially with the pulse tube.

6. The pulse tube refrigerator according to claim 1, wherein the hollow draft tube comprises a heat-exchanger high-temperature-end draft-tube segment extending from the regenerator draft-tube segment into the high-temperature end heat exchanger.

7. The pulse tube refrigerator according to claim 4, wherein a flow-regulating mesh is fixed to an outer wall of the pulse-tube draft-tube segment.

8. The pulse tube refrigerator according to claim 6, wherein at least one sensor is disposed on at least either an inner wall or an outer wall of the draft tube, the at least one sensor being connected with a lead wire, the lead wire penetrating the inside of the heat-exchanger high-temperature-end draft-tube segment and from a terminus of the heat-exchanger high-temperature-end draft-tube, heading exteriorly and extending to an external of the pulse tube.

9. The pulse tube refrigerator according to claim 1, wherein an outer contour of the cross section of the draft tube is circular or regular polygonal.

10. The pulse tube refrigerator according to claim 1, further comprising:

a compressor, a transport tube, and an aftercooler, connected in that order, wherein the regenerator draft-tube segment extends into the transport tube.

11. The pulse tube refrigerator according to claim 1, wherein the regenerator draft-tube segment is a structure that is sealed to the atmosphere.

* * * * *